United States Patent [19]

Cloup

[11] 4,060,351

[45] Nov. 29, 1977

[54] CONTROLLED INLET VALVES FOR METERING PUMPS

[76] Inventor: Jean Cloup, 33360 Latresne, France

[21] Appl. No.: 662,584

[22] Filed: Mar. 1, 1976

[30] Foreign Application Priority Data

Mar. 5, 1975 France ..... 75.06915

[51] Int. Cl.[2] ..... F04B 7/00

[52] U.S. Cl. ..... 417/520; 251/332

[58] Field of Search ..... 417/443, 444, 445, 511, 417/520, 456, 457; 251/332

[56] References Cited

U.S. PATENT DOCUMENTS

| | | | |
|---|---|---|---|
| 27,128 | 2/1860 | Holly | 417/443 |
| 2,083,584 | 6/1937 | Wineman | 251/332 |
| 2,254,084 | 8/1941 | Nilson | 417/443 |
| 3,023,710 | 3/1962 | Tyree | 417/520 |
| 3,233,863 | 2/1966 | Bowen et al. | 251/332 |
| 3,272,218 | 9/1966 | Johnson | 251/332 |
| 3,888,552 | 6/1975 | Fontaine | 417/445 |

*Primary Examiner*—Carlton R. Croyle
*Assistant Examiner*—R. E. Gluck
*Attorney, Agent, or Firm*—Bucknam and Archer

[57] ABSTRACT

This invention relates to controlled inlet valves for metering pumps. The metering pumps for which the valve of the invention is applicable are of the kind comprising a cylinder in which moves a piston to which a reciprocating movement is imparted. In the valve of the invention a member is mounted to slide in the pump cylinder and one of the ends of this member has an obturator which co-operates with a sealing gland arranged at the inlet opening to the cylinder. The sliding member is selectively coupled at its other end to the piston and is subject to the urging of an elastic member which is capable of thrusting the obturator back to the closed position.

3 Claims, 2 Drawing Figures

CONTROLLED INLET VALVES FOR METERING PUMPS

BACKGROUND OF THE INVENTION

The present invention relates to controlled inlet valves for metering pumps.

To inject metered amounts of liquid into another liquid, it is known to use a metering pump which consists of a cylinder in which moves a piston. The piston draws the liquid to be metered from a container and pumps it into a second container which holds the other liquid. The second container may in particular be an injector device as described in French Patent Application No. 72.39699.

However, if a valve of a conventional type which opens under atmospheric pressure is used at the inlet when the fluid pressures involved are very low, this results in the valve closing in an unsatisfactory fashion and the metering action being such that the metering device operates incorrectly.

It is an object of the invention to provide a device which shall minimise or overcome these disadvantages by the use of a positively controlled valve.

SUMMARY OF THE INVENTION

The invention consists in a controlled inlet valve for a metering pump, which pump consists of a cylinder in which moves a piston to which a reciprocating movement is imparted, wherein a member is mounted to slide in said pump cylinder, one of the ends of said member having an obturator which co-operates with a sealing gland arranged at the inlet opening to the cyclinder, the said slidable member being selectively coupled at its other end to the piston and being subject to the urging of an elastic member which is capable of thrusting the obturator back to the closed position.

BRIEF DESCRIPTION OF THE DRAWINGS

In order that the invention shall be more clearly understood, reference will now be made to the accompanying drawings which show the embodiment thereof by way of example and in which.

DETAILED DESCRIPTION OF THE PREFERRED EMBODIMENT

Figure 1:
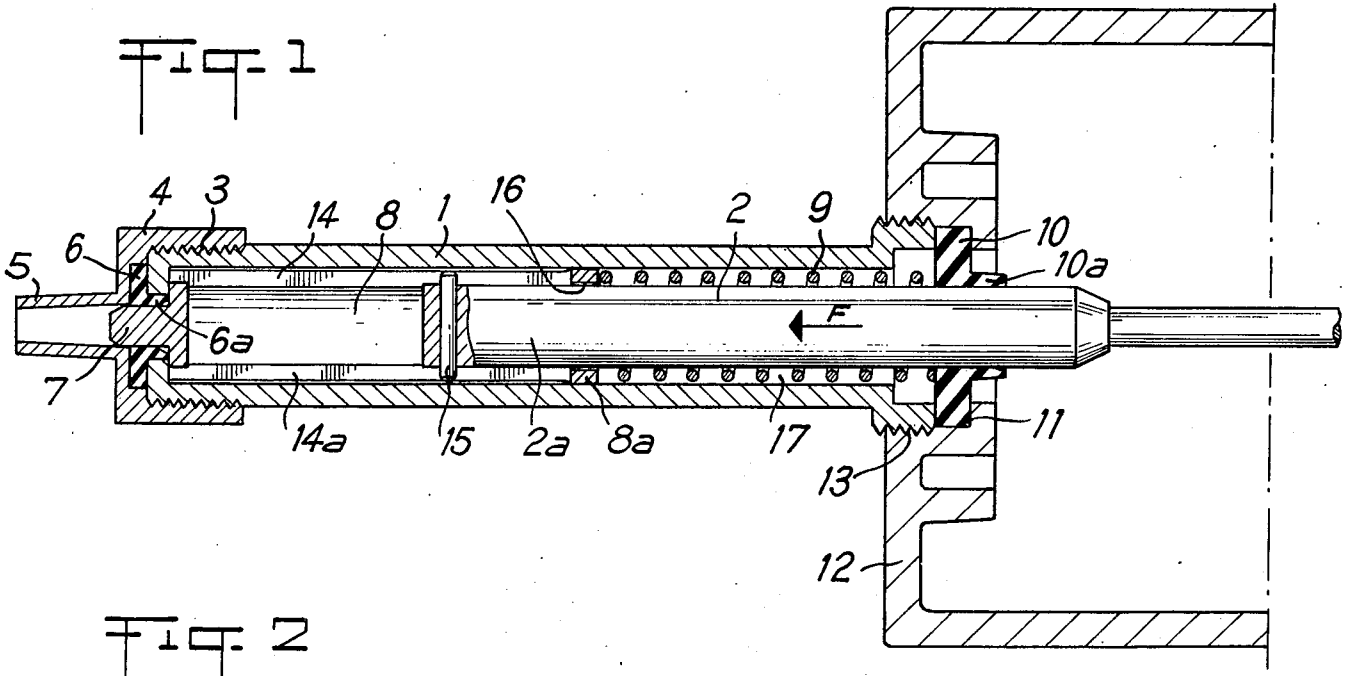
FIG. 1 is a longitudinal section through a metering pump fitted with an intake valve according to the invention, which is shown in the closed position.
Figure 2:
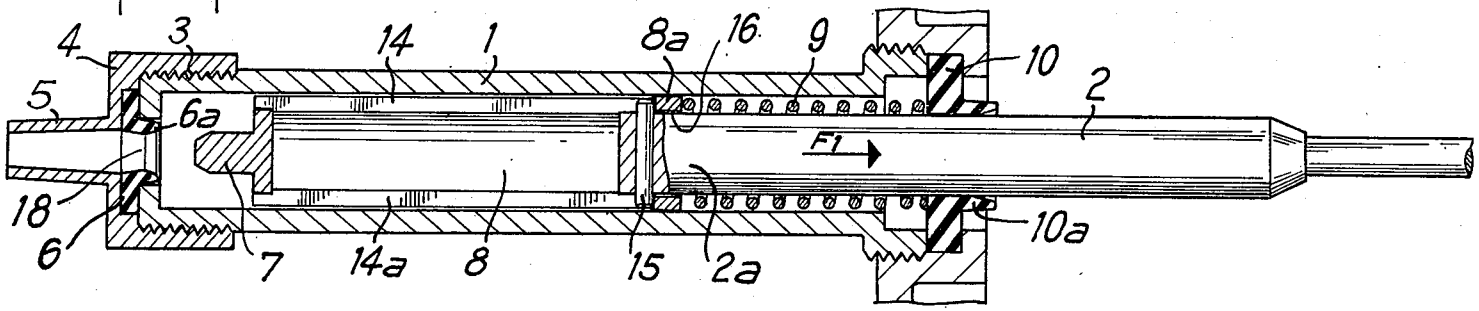
FIG. 2 is a similar view of the pump when the inlet valve is in the open position.

Referring now to the drawings, in FIGS. 1 and 2 is shown a metering pump, which consists of a cylinder 1 in which a piston 2 is mounted to slide. The said cylinder has at one of its ends a threaded portion 3 onto which a cap 4 is screwed, the cap 4 being provided with an inlet tube 5 which is connected in a known manner to a container for liquid to be metered which is not shown in the drawings.

Between the cap 4 and the body 1 is clamped a sealing gland 6 made of an elastic material which has a circular lip 6*a* which defines an inlet opening in which an obturator 7 is engageable. The obturator 7 is formed by a stud attached to a tubular member 5 in which an end 2*a* of piston 2 is mounted to slide.

At the opposite end from obturator 7, tubular member 8 is subject to the urging of a coil spring 9 which bears against a sealing gland 10 made of an elastic material. Sealing gland 10 has a circular lip 10*a* which fits round piston 2 and forms an outlet valve, the said gland being held clamped between cylinder 1 and a shoulder 11 on a container 12. Cylinder 1 is mounted on container 12 by means of a threaded portion 13 provided at its other end, which corresponds to the outlet for the liquid.

In the tubular obturator member 8 are provided two longitudinal slots 14, 14*a* in which move the ends of a pin 15 attached to the end 2*a* of piston 2, the ends of the said pin 15 being capable of coming to bear against an annular base 8*a* on the tubular member which forms the end, of slots 14, 14*a*.

An annular gap 16 is provided between tubular member 8 and piston 2 to allow the liquid to flow out.

The device according to the invention operates in the following way:

When piston 2 is moved in the direction of arrow F (FIG. 1), i.e. during the delivery period, tubular member 8 is subject to the urging of spring 9, which forces the obturator member 7 into the opening 18 defined by the circular lip 6*a* on the sealing gland, thus positively closing the inlet tube 5 for the liquid to be metered.

Pin 15 moves in slots 14, 14*a* without acting on the tubular member 8 in which piston 2 is sliding.

The liquid which was admitted to cylinder 1 during the previous stroke is pumped by piston 2 and flows through the annular gap 16 into the chamber 17 which is formed between the piston and the cylinder.

Being under pressure, the liquid lifts the circular lip 10*a* which deforms elastically to allow it to pass into container 12.

When piston 2 is moved in the direction of arrow F1, there is produced in cylinder 1 a slight reduction in the pressure intended to assist in the intake of the liquid, the relevant part of the travel of piston 2 being that in which the pin 15 moves in slots 14, 14*a* without carrying the tubular member 8 along with it. At the end of this part of the travel of the piston, the ends of pin 15 come up against the annular base 8*a* (FIG. 2) of the tubular obturator member 8, which is thus coupled to piston 2 and carried along with it in direction F1 in opposition to spring 9, which is compressed.

The movement of tubular member 8 causes obturator 7 to be drawn out of the circular lip 6*a* and the inlet opening 18 to be opened so as to allow liquid to enter cylinder 1.

When piston 2 is moved back in the direction of arrow F, tubular member 8 again becomes subject to the urging of spring 9, which causes obturator 7 to be inserted in the opening 18 defined by the circular lip 6*a*, and the cycle described above begins again.

I claim:

1. A controlled inlet valve for a metering pump, said pump comprising a cylinder having an inlet opening and an outlet opening, a piston moveable in said cylinder, and means for imparting a reciprocating movement to said piston, wherein a member is mounted to slide in said pump cylinder, one of the ends of said member having an obturator which cooperates with a sealing gland arranged at the inlet opening to said cylinder, said slidable member being selectively coupled at its other end to the piston and being subject to the urging of an elastic member which is capable of thrusting said obturator back to the closed position, said sliding obturator member being tubular and containing at least one longitudinal slot in which is engaged a pin attached to the end of said piston, which piston is mounted to slide in said tubular obturator member, said pin being capable of coming to bear against a base of said tubular member which forms the boundary of said slot at the opposite end from said obturator.

2. An inlet valve according to claim 1, wherein said obturator is formed by a stud attached to said tubular obturator member which is capable of being inserted in an opening defined by a lip on a sealing gland arranged at the inlet to the cylinder.

3. A controlled inlet valve for a metering pump, said pump comprising a clyinder having an inlet opening and an outlet opening, a piston moveable in said cylinder, and means for imparting a reciprocating movement to said piston, wherein a member is mounted to slide in said pump cylinder, one of the ends of said member having an obturator which cooperates with a sealing gland arranged at the inlet opening to said cylinder, said slidable member being selectively coupled at its other end to the piston and being subject to the urging of an elastic member which is capable of thrusting said obturator back to the closed position, and another sealing gland fitted near the outlet opening of said cylinder, said other sealing gland having a lip which fits around said piston and forms an outlet valve.

* * * * *